US006178797B1

(12) United States Patent
Marshall et al.

(10) Patent No.: US 6,178,797 B1
(45) Date of Patent: Jan. 30, 2001

(54) LINKING APPARATUS AND METHOD FOR A CAN SHAPING SYSTEM

(75) Inventors: Harold James Marshall; Mohamad Hachem Saadi El Hachem, both of Lynchburg, VA (US)

(73) Assignee: Delaware Capital Formation, Inc., Wilmington, DE (US)

( * ) Notice: Under 35 U.S.C. 154(b), the term of this patent shall be extended for 0 days.

(21) Appl. No.: 09/344,377

(22) Filed: Jun. 25, 1999

(51) Int. Cl.[7] ..... B21D 51/26
(52) U.S. Cl. ..... 72/94; 198/576
(58) Field of Search ..... 72/94; 198/576, 198/583; 413/69

(56) References Cited

U.S. PATENT DOCUMENTS

| | | | | |
|---|---|---|---|---|
| 4,732,027 | * | 3/1988 | Traczyk et al. | 413/69 |
| 5,553,826 | | 9/1996 | Schultz | 248/678 |
| 5,611,231 | | 3/1997 | Marritt et al. | 72/94 |
| 5,785,294 | | 7/1998 | Schultz | 248/678 |
| 6,085,563 | | 7/2000 | Heiberger et al. | 72/94 |

OTHER PUBLICATIONS

Belvac Production Machinery; 595 Tandem Necker; Dec. 20, 1991; Engineering Drawing No. 270092.5, showing drive arrangement.

Belvac Production Machinery; Model 595 N/N/N Tandem; Aug. 16, 1991; set of four Engineering Drawings, No. 2700818, showing a tandem drive with vacuum transfer.

* cited by examiner

*Primary Examiner*—Lowell A. Larson
(74) *Attorney, Agent, or Firm*—Foley & Lardner

(57) ABSTRACT

A linking apparatus and method for connecting two can making and processing machines. The linking arrangement includes a coupling arrangement synchronously connecting the respective drive arrangements for the two machines, and a transfer member for sequentially transferring can bodies between the two machines. The coupling arrangement includes a first gear drivingly connected to a first one of the machines, a second gear drivingly connected to a second one of the machines, and an intermediate gear interengagingly connected between the first and second gears. The transfer member includes a vacuum star-wheel driven by the intermediate gear.

27 Claims, 8 Drawing Sheets

LINKING APPARATUS AND METHOD FOR A CAN SHAPING SYSTEM

BACKGROUND OF THE INVENTION

1. Field of the Invention

The present invention relates to systems of machines for reshaping cylindrical metal bodies, i.e., cans. In particular, the present invention is directed to a linking apparatus and method for connecting different machines that are used to shape cans.

2. Description of the Related Art

There are a wide variety of cylindrical containers constructed from different materials and in different configurations to accommodate a wide variety of uses. Various types of ductile metal cans are used to provide packaging for a wide variety of foods, beverages and others products, the package being hermetically sealed and possibly under natural or created pressure conditions, or under vacuum.

One popular can, offered in different sizes, is the so-called beer/beverage can having a unitary drawn can body to which an easy-opening end is attached after filling. Other cans, often of the wide-mouth type, are used to package cheese spreads, nuts, and other food products which may be only hermetically sealed, or may be vacuum packed in some instances or packed with an inert gas under pressure in other instances. Additionally, products that use aerosol or other propellants are commonly packaged in metal cans.

In aggregate, the market demand for all of the various types of metal body cans amounts to billions of units.

Originally, metal cans were formed of three separate pieces. A rectangular metallic sheet was rolled into a cylinder, with the seam portion along its length being soldered or welded to a leak-proof state. The top and bottom edges of the cylindrical body were flanged to accept an end wall element at each end thereof. The end walls were sealed to the cylindrical body by means of the conventional double seaming operation.

More recently, three-piece container bodies have been increasingly replaced, especially in the beverage field, with two-piece drawn and ironed cans. In such a system, a circular blank of sheet material is drawn into a cup-like shape. Subsequently, the cup is redrawn to lengthen the sidewall and reduce the diameter thereof. Next, the sidewall is lengthened and thinned by ironing between punch and die members. Finally, the closed bottom is forced against a bottom former, which shapes the bottom portion, adding strength to the container.

At first, these two-piece containers were flanged and given a single end wall in the same manner as the three-piece container. However, since both top and bottom end walls were not necessary, space savings in storage of filled containers and metal usage reduction could be realized by necking the open edge portion of the container body inwardly, prior to placing the end wall thereon, such that the end wall diameter did not exceed the side wall diameter of the container body. Such an inward necking of container bodies is now commonplace.

In a further attempt to reduce metal usage, it was next proposed to reduce further the diameter of the open container edge by means of additional necking stages. Thus, container bodies were necked as many as eight times, then flanged, on a single fixed base machine. This proved successful in further reducing metal usage, without substantially adversely affecting the container.

Traditional installations combined the various processing stages in a single "fixed base" machine. Such fixed base machines were extremely large, heavy and cumbersome to ship and install. Moreover, these fixed base machines could not be reconfigured to accommodate alternative or additional processes.

More recently, installations for making and processing cans of metal are known in which the ironing of the can bodies from cups, the trimming of the can rim, the forming of the can bottom, the washing and drying, inside coating and decorating, and finally also the making of the can rim and the flanging are carried out in successive operations on separate machines. Relatively expensive transporting devices interconnect these separate machines. Because the production output of these interconnected separate machines is not always the same, it becomes necessary to incorporate branches in the transporting devices, as well as accumulation devices, for the production flow to split or be rejoined.

A disadvantage of these known combinations of separate machines and transporting devices is that they also require considerable space because of the relatively great number of individual machines and all the transporting devices that are required between the individual machines. Another disadvantage of these known combinations is that the branching-off and rejoining of production flows requires complicated circuits and systems for controlling the installation. Yet another disadvantage of these known installations is that the transporting devices frequently damage the cans passing through the relatively long and frequent direction-changing path.

Over the years, the assignee of the present invention has been responsible for numerous advances in can making technology. These innovations have enabled increases in line speed and improvements in quality and productivity, while significantly reducing materials costs. Previously, the assignee has introduced such innovations as a tandem drive system and a modular necking system.

The assignee's tandem drive system 100 is illustrated in FIGS. 6–8. The tandem drive system 100 commonly drives two otherwise separate machines 102 and 104 with a single motor 110. A pair of drive pulleys 112 are identically driven by the motor 110. A pair of drive belts 114 and 116 transfers torque from the drive pulleys 112 to a pair of driven pulleys 118 and 120, respectively. Torque from the driven pulley 118 is transferred to the first machine 102 via a right-angle drive unit 122, and torque from the driven pulley 120 is transferred to the second machine 104 via a right-angle drive unit 124.

A vacuum star-wheel 130 is used to convey cans from the first machine 102 to the second machine 104. The star-wheel 130 includes a plurality of pockets 132 around its circumferential periphery for engaging and moving a sequential flow of can bodies. Each of the pockets 132 is shaped to correspond to the curvature of the can bodies and includes one or more suction surfaces (not shown) for engaging and retaining a can body in a respective one of the pockets 132. The star-wheel 130 is rotated via an arrangement 140 including a drive pulley 142 turned by the first machine 102, a drive belt 144, and a driven pulley 146 connected to the star-wheel 130.

Referring to FIG. 8, a pair of idler wheels 148 ensure that the drive pulley 142 rotates in the opposite direction of rotation with respect to the driven pulley 146. This is necessary for handing-off the can bodies from the first machine 102 to the star-wheel 130. A tension wheel 150 ensures that the drive belt 144 transfers the torque between the drive pulley 142 and the driven pulley 146.

In operation, the pockets 132 are controllably connected to a vacuum source 106 of the first machine 102 for selectively engaging and releasing a can body. The can bodies are engaged and released based on the angular position of the star-wheel 130 and the relative position of a pocket with respect to the first and second machines 102 and 104.

The assignee's modular necking system is described in U.S. Pat. No. 5,611,231, which is hereby incorporated by reference. The modular necking system dramatically decreases wasted floor space, can damage, labor and training. The reduction of costly space and air consuming trackwork, elevators and other redundant equipment offers a significantly simpler process and significant savings. The modular system minimizes installation and platform costs, and controls can transportation throughout the entire process. This reduced can handling, as compared to that of interconnecting trackwork and conveyors, preserves can quality and reduces spoilage.

Applicants of the present invention have recognized that there is a need to provide a coupling between different combinations of fixed base and modular can making machines

SUMMARY OF THE INVENTION

It is, therefore, an object of the present invention to provide an installation for the manufacture of cans which will require only a relatively small space, is simple in construction and, in which the cans are carefully handled while passing through the installation.

Another object of the present invention is to connect necking machines together in an arrangement where the containers can be transferred from one machine to another in a controlled state, with the containers relative positioning being maintained throughout the process.

This is achieved by adding an offset gear train from the existing gear train on the back of two machines and coupling it directly to each of the machines. The offset gear train is externally mounted with respect to the existing system, the new module, or both. In a preferred embodiment of the present invention, the gear train comprises of three gears with the outside gears coupled to respective end gears of each machine and the center gear driving a vacuum transfer star-wheel which transfers the containers from a first machine to a second machine. This arrangement of three gears also maintains the proper shaft rotation required for transferring containers. The vacuum transfer star-wheel transports the can from the discharge star-wheel of the first machine to the infeed star-wheel of the second machine, ensuring positive can handling through the entire process.

The present invention provides a linking apparatus for connecting existing fixed base machines, connecting existing fixed base machines to new modular machines, and connecting existing or new modular machines to one another. For example, the linking apparatus according to the present invention may be used to connect a new installation of modules, and subsequently add additional modules such as a necker, a flanger, a base reformer, a base re-profiler, an inspection, a dual infeed, or an intermediate discharge module(s).

The main drive arrangement of the combined machines will be determined by the specific configuration of machines. The design of the drive assembly for the modules easily accepts machine expansion by accommodating motors and gear reducers to meet the required horsepower. In some instances, the drive assembly from the existing machine is utilized, or the appropriate driver assembly is added when a module and a linking apparatus are added. However, it is advantageous to position the main drive as close to the center of the combined machine as possible.

The electrical controls system for the modules include quick disconnects and a common wiring scheme, allowing modules to be easily plugged together during installation and addition of future modules. To link the electrical controls of an existing fixed base machine to a new module, the existing logic and control panel is utilized, or the applicable modifications are made to control both systems.

The above objects, as well as additional objects and advantages that will become apparent from the following detailed description, are accomplished by a linking apparatus for sequentially transporting a plurality of elements between a first machine and a second machine, the first machine includes a first rotatable drive arrangement and the second machine include a second rotatable drive arrangement that is independently rotatable with respect to the first drive arrangement. The linking apparatus comprises a coupling arrangement adapted for connecting the first and second drive arrangements for synchronous rotation with respect to one another, the coupling arrangement including: a first rotating member adapted to be connected for common rotation with the first drive arrangement, a second rotating member adapted to be connected for common rotation with the second drive arrangement, the second rotating element being coupled for interrelated rotation with the first rotating member, and an intermediate rotating member coupled for interrelated rotation between the first and second rotating members; and a transfer member adapted for sequentially transporting the plurality of elements between the first and second machines, the transfer member being connected for common rotation with the intermediate rotating member.

The above objects, as well as additional objects and advantages that will become apparent from the following detailed description, are further accomplished by an assembly for shaping cans. The assembly comprises a first machine adapted for performing a can shaping operation, the first machine including a first base, a first transport arrangement adapted for moving the cans relative to the first base, and a first gear train driving the first transport arrangement; a second machine adapted for performing a can shaping operation, the second machine including a second base, a second transport arrangement adapted for moving the cans relative to the second base, and a second gear train driving the second transport arrangement; and a linking apparatus synchronously connecting the first and second gear trains and adapted for transporting the cans between the first and second transport arrangements, the linking apparatus including: a coupling arrangement having a first gear rotating in common with the first gear train, a second gear rotating in common with the second gear train, and an intermediate gear rotatably interengaging the first and second gears, and a transfer wheel rotating in common with the intermediate gear and having a plurality of vacuum fixtures adapted for respectively engaging ones of the cans when the cans are being transported between the first and second transport arrangements.

The above objects, as well as additional objects and advantages that will become apparent from the following detailed description, are further accomplished by a method of transferring cans from a first machine to a second machine, the first machine including a first gear train and the second machine including a second gear train. The method comprises connecting a coupling arrangement adapted for synchronizing rotation of the first and second gear trains, the coupling arrangement including: a first gear adapted to be connected for common rotation with the first gear train, a second gear adapted to be connected for common rotation with the second gear train, the second gear being coupled for interrelated rotation with the first gear, and an intermediate gear coupled for interrelated rotation between the first and second gears; and connecting a transfer member for common rotation with the intermediate gear, the transfer member being adapted for receiving the cans from the first machine and discharging the cans to the second machine.

The objects and advantages of the present invention will be set forth in the description that follows, and in part will be readily apparent to those skilled in the art from the description and drawings, or may be learned by practice of the invention. These objects and advantages of the invention may be realized and obtained by means of the instrumentalities and combinations particularly pointed out in the appended claims.

DETAILED DESCRIPTION OF THE PREFERRED EMBODIMENT

Figure 1:
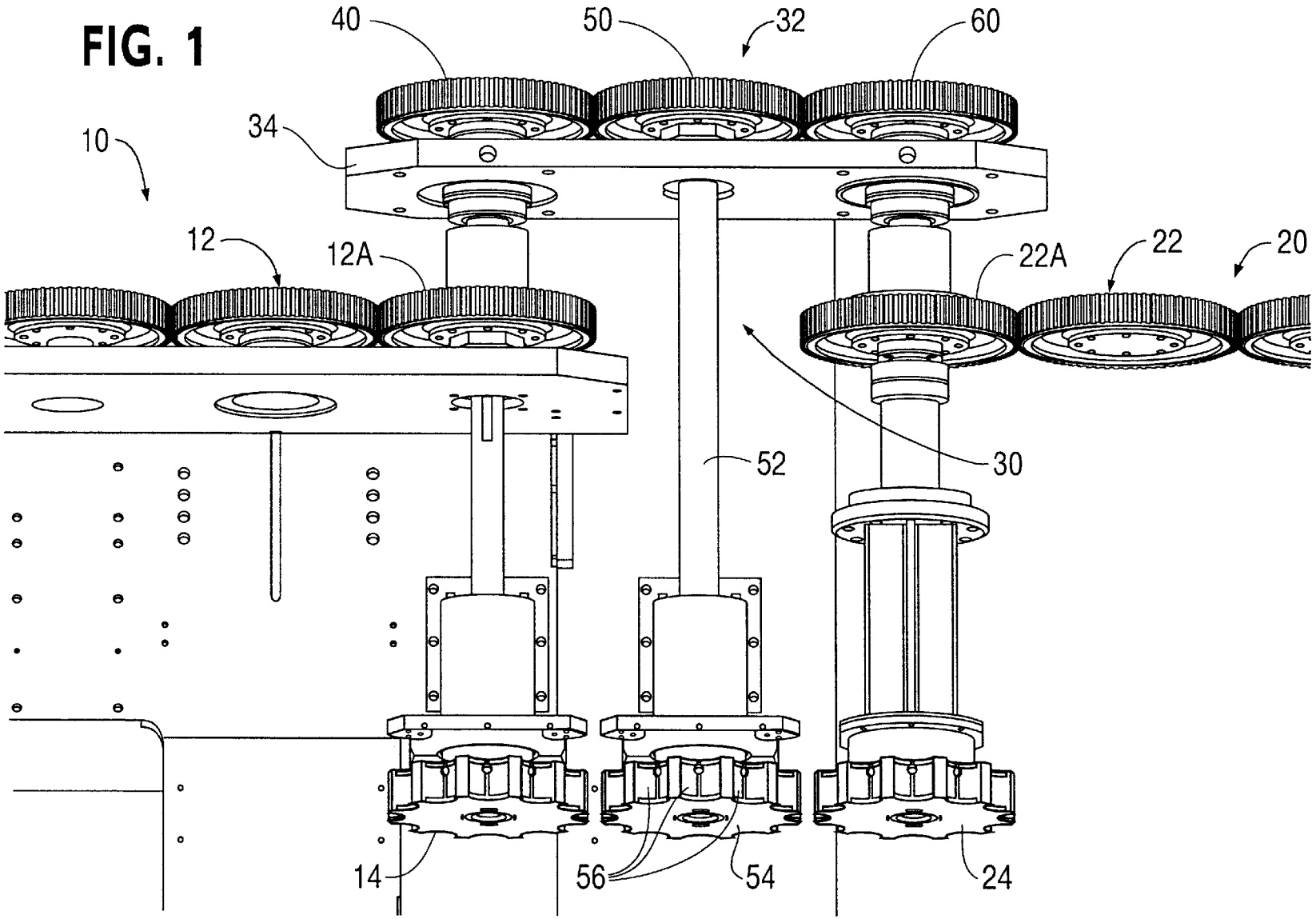
FIG. 1 is a perspective plan view of a linking apparatus according to the present invention.
Figure 2:
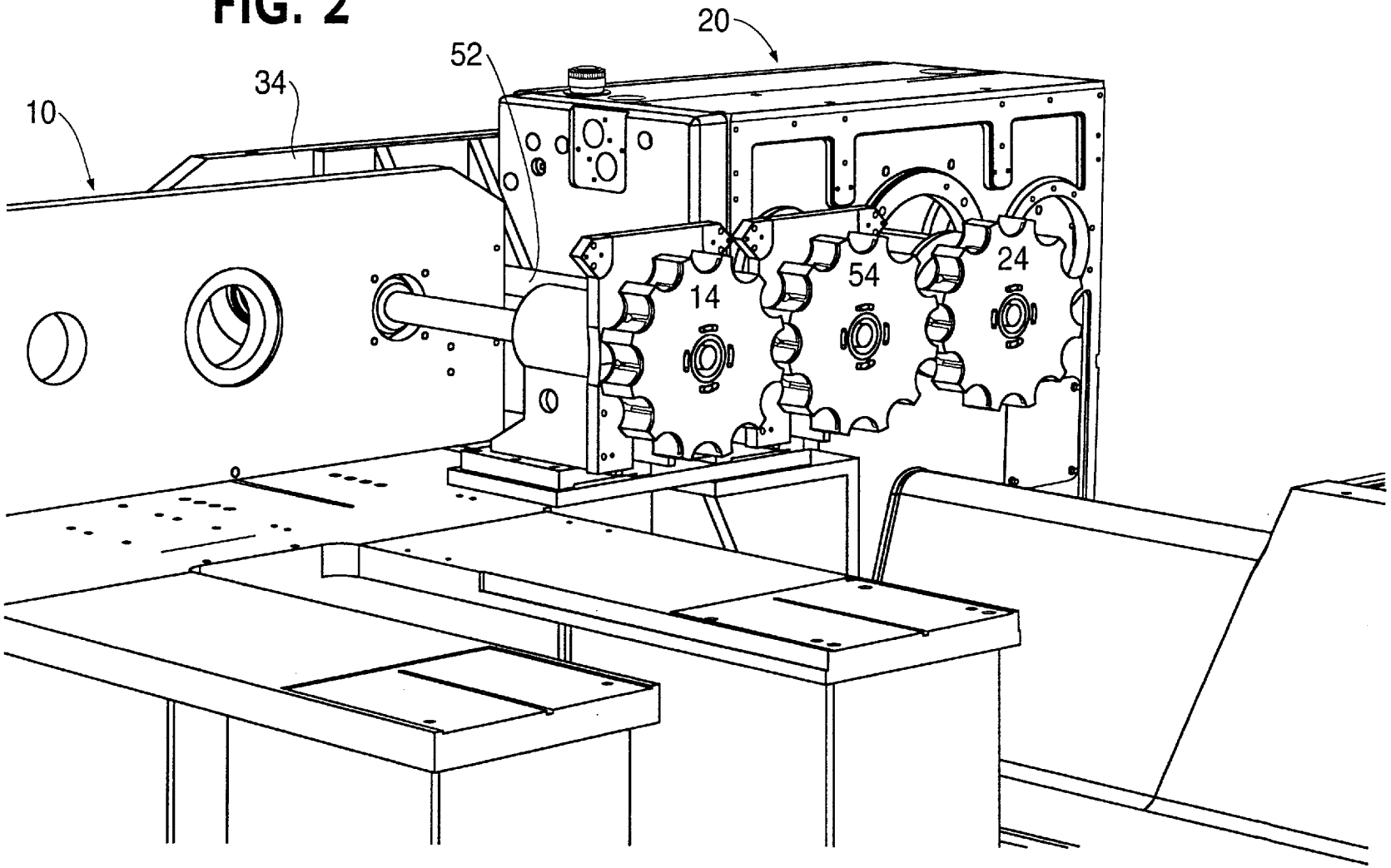
FIG. 2 is a perspective elevation view of the linking apparatus shown in FIG. 1.
Figure 3:
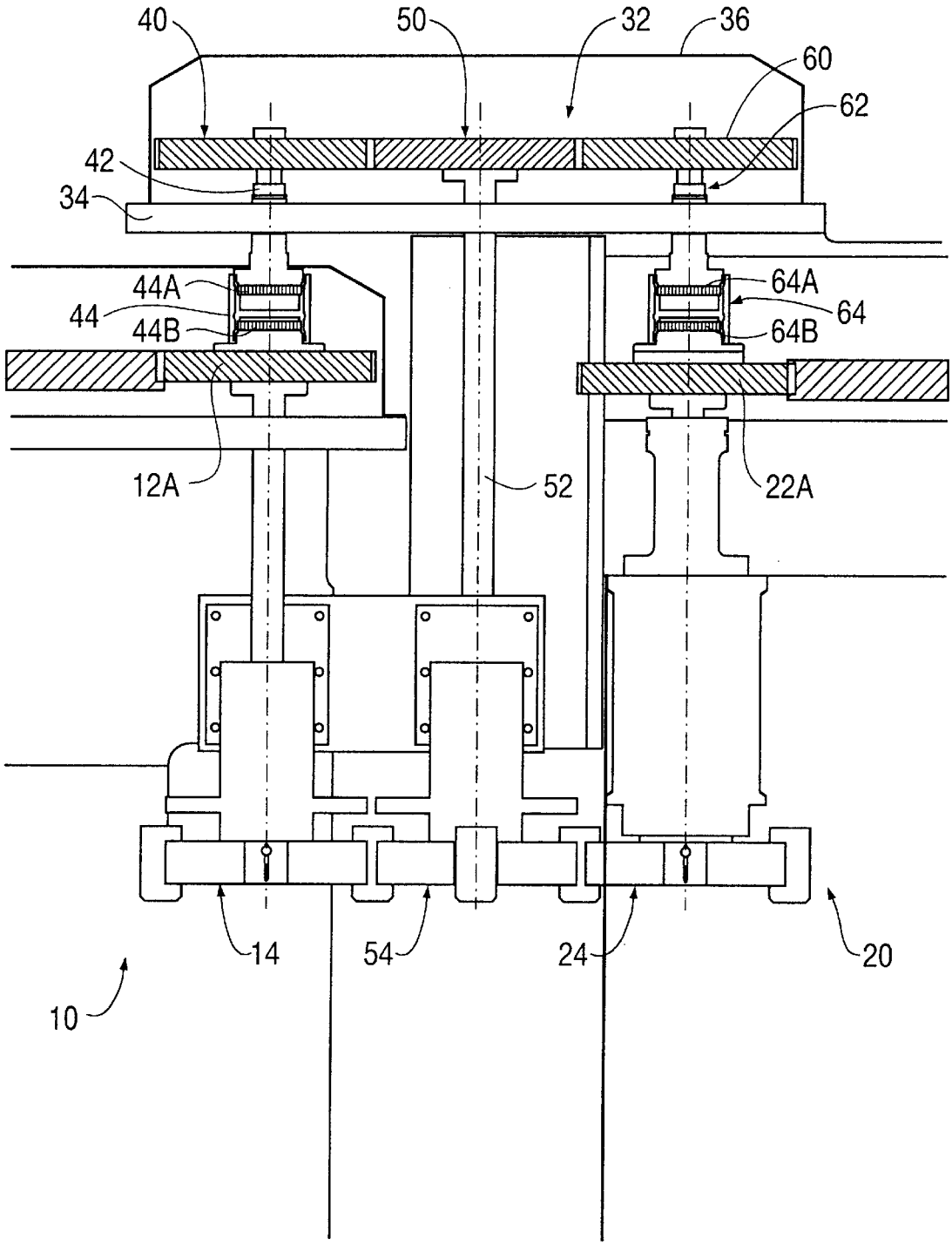
FIG. 3 is a top plan view of the linking apparatus shown in FIG. 1.
Figure 4:
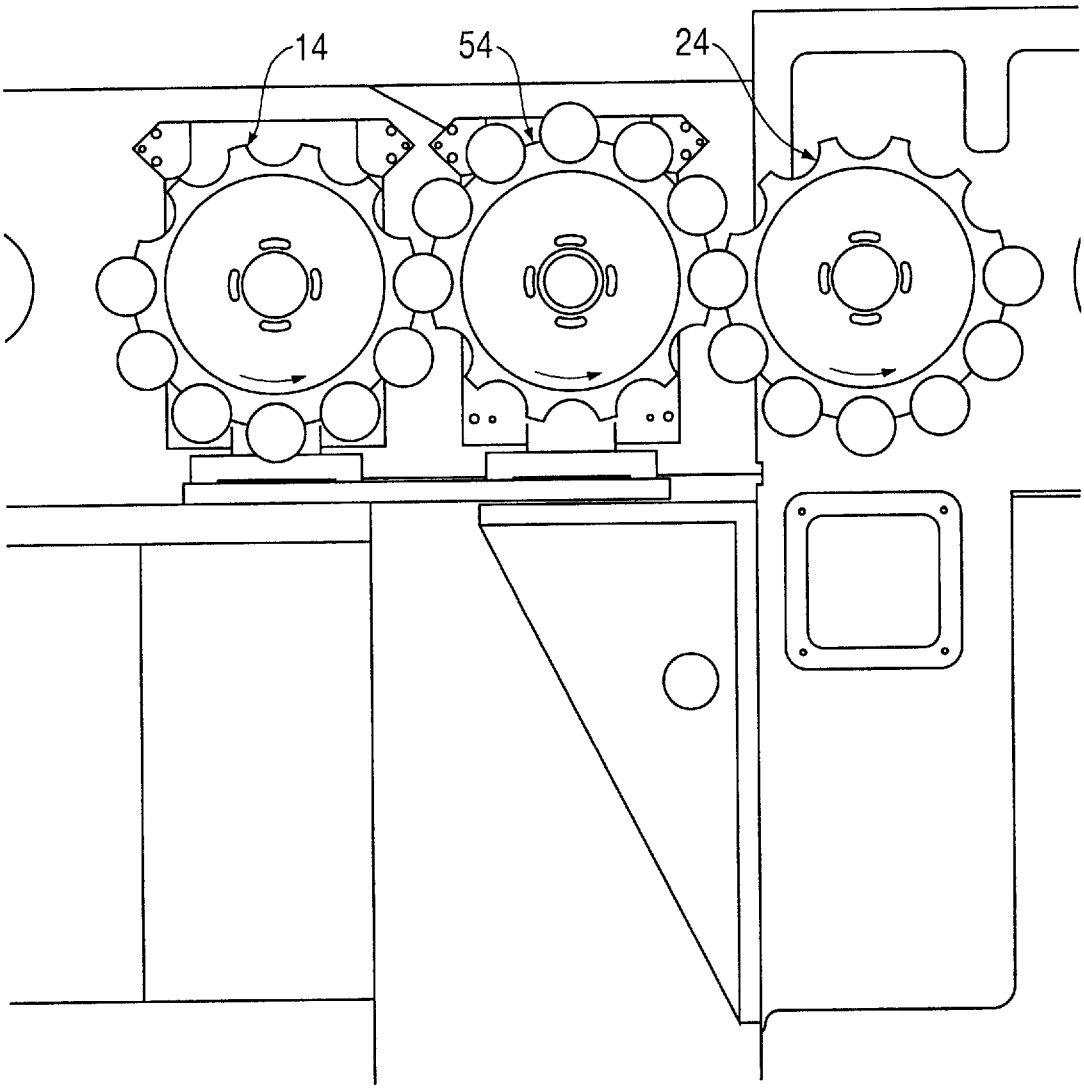
FIG. 4 is a front elevation view of the linking apparatus shown in FIG. 1.

FIGS. 1–5 show a preferred embodiment of the present invention linking a first machine 10 to a second machine 20. The first machine 10 includes a first drive arrangement 12, and the second machine 20 includes a second drive arrangement 22. Typically, the first and second drive arrangements 12,22 will each comprise a gear train including a plurality of gears engaged for concomitant rotation. Of course, other types of drive arrangements, e.g., sprocket and chain, cog pulley and cog belt, etc., may be used in the machines 10,20.

Each of the machines 10,20 may perform one or more of a variety of can making and processing operations including drawing and ironing, bottom forming, trimming, one or more stages of necking, and flanging. Other types of can making and processing operations include washing and drying, inside coating, and decorating. Of course, different or additional operations may also be used to make particular types of containers other than cans.

In an unassociated condition, i.e., when the first and second machines 10,20 are physically and functionally disconnected from one another, the respective first and second drive arrangements 12,22 are independently rotatable with respect to one another. It is an object of the present invention to provide a linking apparatus for establishing a physical and functional connection between the first and second machines 10,20. In particular, it is an object of the present invention to provide a linking apparatus that synchronously connects the first and second drive arrangements 12,22, and that sequentially transfers elements, e.g., containers, can bodies, etc., between the first and second machines 10,20.

Referring to the first and second machines 10,20 illustrated in FIGS. 1–5, the first drive arrangement 12 terminates in a first gear 12A drivingly connected to a first vacuum star-wheel 14, and the second drive arrangement 22 terminates in a second gear 22A drivingly connected to a second vacuum star-wheel 24. The first and second star-wheels 14,24 define the ends of respective transport arrangements for the first and second machines 10,20. Of course, the transport arrangements may alternatively or additionally include other types of conventional element transporting arrangements, e.g., trackwork, elevators, etc.

The first gear 12A, second gear 22A, first star-wheel 14, and second star-wheel 24 are rotatably supported with respect to respective portions of the first and second machines 10,20 by bearings in a conventional manner.

A linking apparatus 30 comprises a coupling arrangement 32 including a first rotating member 40, an intermediate rotating member 50, and a second rotating member 60. Although the rotating members 40,50,60 have been illustrated as three gears engaged for concomitant rotation, additional rotating members or other types of rotating members may be substituted. It is significant that the first and second rotating members 40,60 rotate in the same direction and that the intermediate rotating member 50 rotates in the opposite direction with respect to the first and second rotating members 40,60. Additional rotating member(s) may also be interposed in the linking apparatus 30 between the intermediate rotating member 50 and the first and second rotating members 40,60. Other types of rotating members that may alternatively or additionally be incorporated include pulleys, sprockets, belts, and chains.

Figure 5:
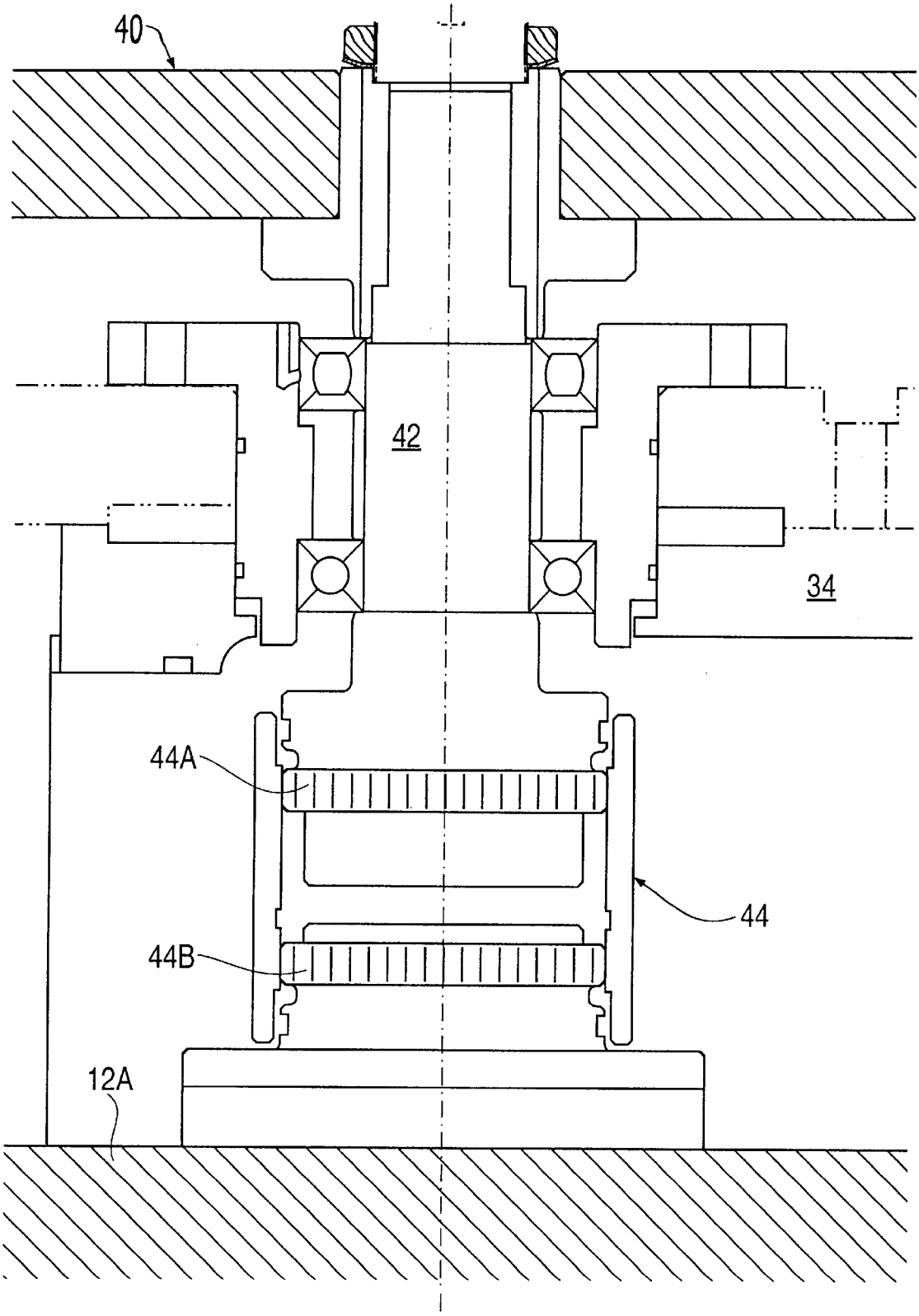
FIG. 5 is a detail view showing a coupling sleeve for the linking apparatus shown in FIG. 1.
Figure 6:
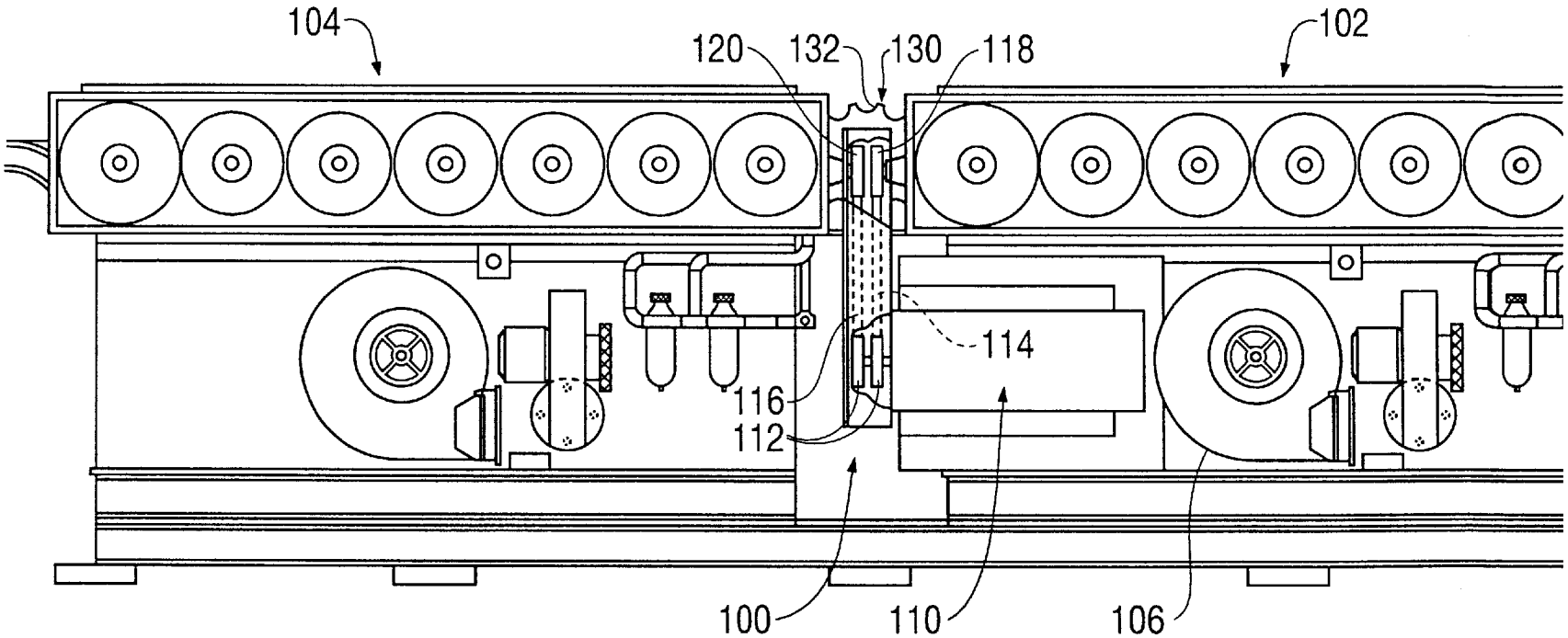
FIG. 6 is a back view of a tandem drive known to the assignee of the present invention.
Figure 7:
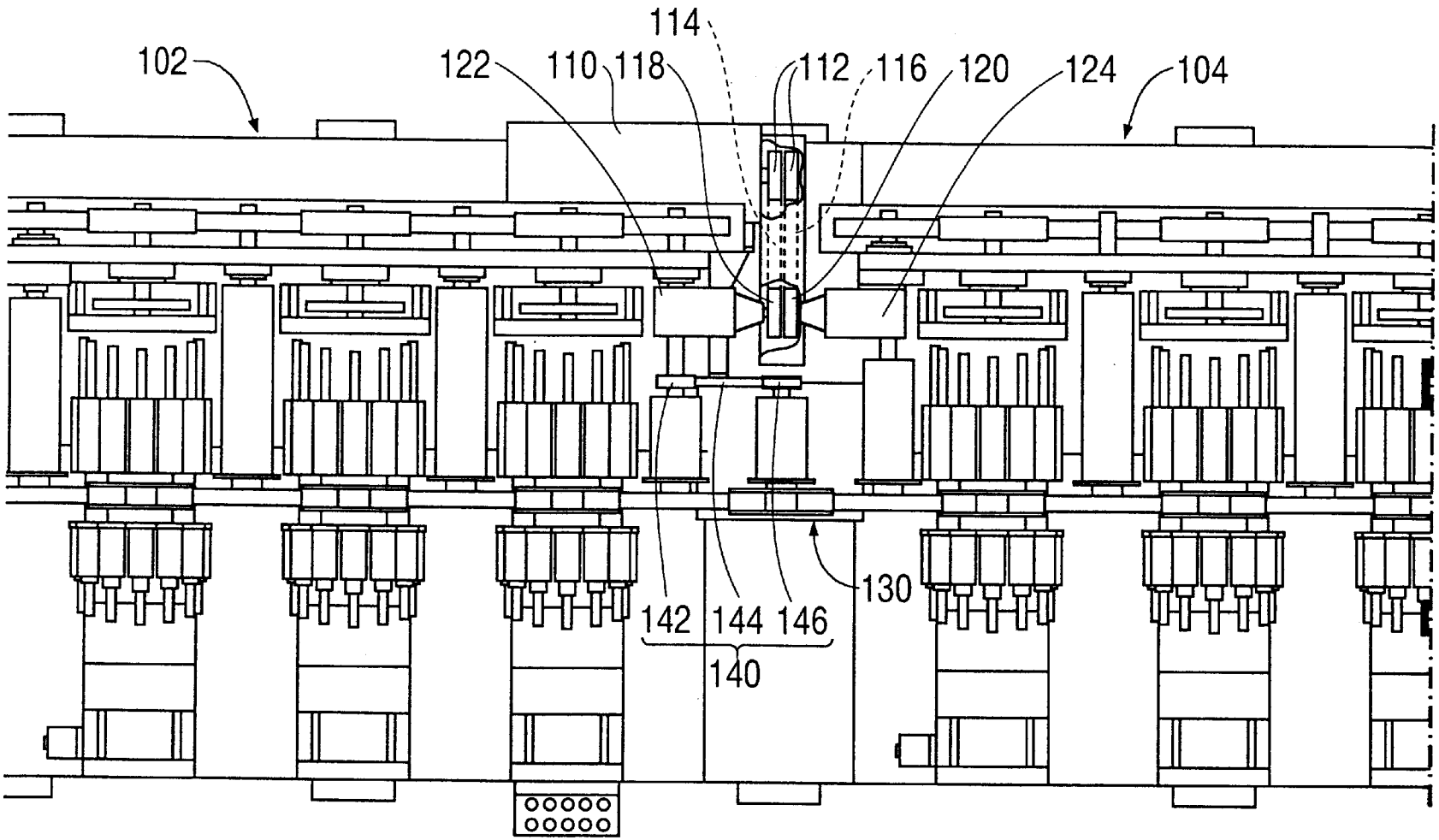
FIG. 7 is a top plan view of the tandem drive shown in FIG. 6.
Figure 8:
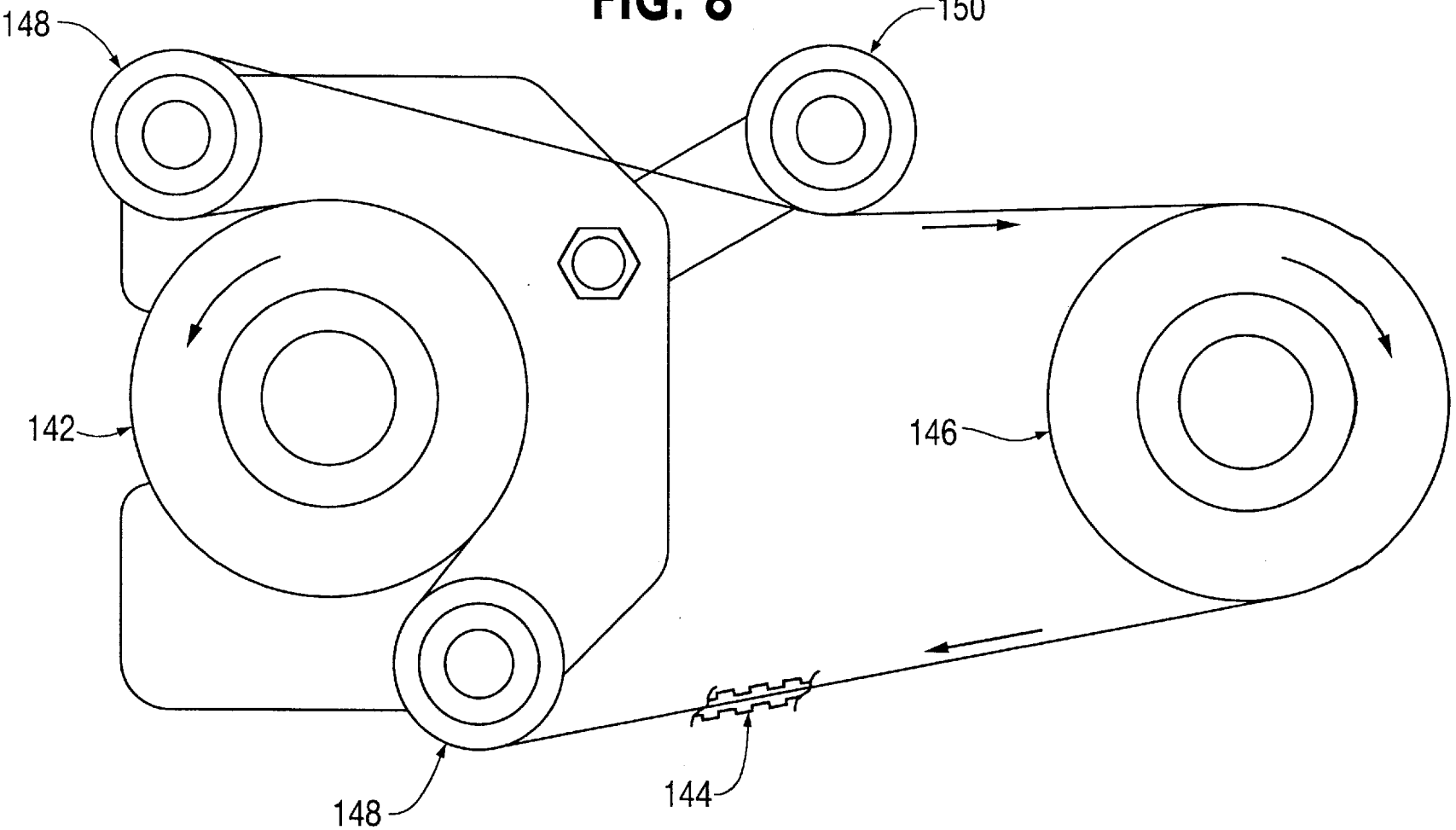
FIG. 8 is a detail view showing the drive arrangement for the tandem drive shown in FIG. 6.

The rotating members 40,50,60 are mutually supported for concomitant rotation on a frame 34 by respective bearings as illustrated in FIG. 5. The coupling arrangement 32 may further be surrounded by a housing 36 cooperating with the frame 34 for substantially encasing the rotating members 40,50,60. The housing 36 may provide a shield for preventing inadvertent contact with the rotating members 40,50,60 or for containing a supply of lubricant for the rotating members 40,50,60.

The first rotating member 40 is rotatably fixed to a first shaft 42 and connected for rotation with the first gear 12A by a clutch 44. According to a preferred embodiment of the present invention shown in FIGS. 3 and 5, the clutch 44 comprises a sleeve that is axially slideable with respect to teeth 44A on the first shaft 42 and engageable with teeth 44B fixed for rotation on the first gear 12A. Similarly, the second rotating member 60 is rotatably fixed to a second shaft 62 and connected for rotation with the second gear 22A by a clutch 64. The clutch 64 comprises a sleeve that is axially slideable with respect to teeth 64A on the second shaft 62 and engageable with teeth 64B fixed for rotation on the second gear 22A. Either or both of the clutches 44,64 may be axially slid to disconnect the respective first rotating member 40,60 from the corresponding gears 12A,22A. Of course, other types and configurations of clutches may be used to establish a connection between the rotation of the corresponding rotating members and gears.

The linking arrangement 30 also includes transfer member including an intermediate vacuum star-wheel 54 that is fixed for rotation with the intermediate rotating member 50 via an intermediate shaft 52. The intermediate star-wheel 54 is positioned between the first and second vacuum star-wheels 14,24 for cooperatively transferring a sequence of containers therebetween using vacuum fixtures 56 around the circumferential periphery of the intermediate star-wheel 54. In particular, the first star-wheel 14, by virtue of being driven in rotation by the gear 12A, handles a sequence of containers being discharged from the first machine 10. The second star-wheel 24, by virtue of being driven in rotation by the gear 22A, handles the sequence of containers being infed into the second machine 20. The intermediate star-wheel 54 passes the sequence of containers from the first star-wheel 14 to the second star-wheel 24 in a conventional manner. Inasmuch as the sequence of containers may be bi-directionally transferable, the directions of rotation of the machines 10,20 and the linking arrangement 30 may be reversible. Consequently, the intermediate star-wheel 54 may also pass the sequence of containers from the second star-wheel 24 to the first star-wheel 14.

The first and second drive arrangements 12,24 are synchronously connected by virtue of the coupling arrangement 32 rotatably connecting the gears 12A,22A. Thus, the drive source(s), e.g., an electric or other motor(s), for either or both of the first or second machines 10,20 may provide the driving force when the machines 10,20 are connected by the linking apparatus 30. Alternatively or additionally, the linking apparatus 30 may be provided with a drive source (not shown) that may be used to provide the driving force for the linking apparatus 30, the first machine 10, the second machine 20, or some combination thereof. Generally, it is preferable for the driving force to be centrally located with respect to the linked machines.

Additional advantages and modifications will readily occur to those skilled in the art. Therefore, the invention in its broader aspects is not limited to the specific details and representative devices, shown and described herein. Accordingly, various modifications may be made without departing from the spirit and scope of the general inventive concept as defined by the appended claims and their equivalents.

We claim:

1. A linking apparatus for sequentially transporting a plurality of elements between a first machine and a second machine, the first machine including a first rotatable drive arrangement and the second machine including a second rotatable drive arrangement that is independently rotatable with respect to the first drive arrangement, the linking apparatus comprising:

a coupling arrangement adapted for connecting the first and second drive arrangements for synchronous rotation with respect to one another, the coupling arrangement including:

a first rotating member adapted to be connected for common rotation with the first drive arrangement, a second rotating member adapted to be connected for common rotation with the second drive arrangement, the second rotating element being coupled for interrelated rotation with respect to the first rotating member, and an intermediate rotating member coupled for interrelated rotation between the first and second rotating members; and a transfer member adapted for sequentially transporting the plurality of elements between the first and second machines, the transfer member being connected for common rotation with the intermediate rotating member.

2. The linking apparatus according to claim 1, wherein each of the rotating members includes a gear, whereby the coupling arrangement includes a gear train.

3. The linking apparatus according to claim 2, wherein the gear train includes an odd number of the gears, the first and second rotating members rotate in a common direction, and the intermediate rotating member rotates in an opposite direction relative to the first and second rotating members.

4. The linking apparatus according to claim 2, wherein the gear train consists of three of the gears.

5. The linking apparatus according to claim 1, further comprising:

a first clutch adapted for connecting the first rotating member to the first drive arrangement; and a second clutch adapted for connecting the second rotating member to the second drive arrangement.

6. The linking apparatus according to claim 5, wherein at least one of the first and second clutches includes an axially displaceable sleeve.

7. The linking apparatus according to claim 5, wherein each of the first and second clutches includes an axially displaceable sleeve.

8. The linking apparatus according to claim 1, further comprising:

a frame adapted to be fixedly connected to at least one of the first and second machines, the frame relatively rotatably supporting the intermediate rotating member and the transfer member.

9. The linking apparatus according to claim 8, wherein the frame includes a housing surrounding the first rotating member, the second rotating member, and the intermediate rotating member.

10. The linking apparatus according to claim 1, wherein the transfer member includes at least one vacuum fixture adapted to engage respective ones of the plurality of elements.

11. The linking apparatus according to claim 1, wherein the coupling arrangement is adapted to be offset axially with respect to the first and second drive arrangements.

12. An assembly for shaping cans, the assembly comprising:

a first machine adapted for performing a can shaping operation, the first machine including a first base, a first transport arrangement adapted for moving the cans relative to the first base, and a first gear train driving the first transport arrangement;

a second machine adapted for performing a can shaping operation, the second machine including a second base, a second transport arrangement adapted for moving the cans relative to the second base, and a second gear train driving the second transport arrangement; and a linking apparatus synchronously connecting the first and second gear trains and adapted for transporting the cans between the first and second transport arrangements, the linking apparatus including:

a coupling arrangement having a first gear rotating in common with the first gear train, a second gear rotating in common with the second gear train, and an intermediate gear rotatably interengaging the first and second gears, and a transfer wheel rotating in common with the intermediate gear and having a plurality of vacuum fixtures adapted for respectively engaging ones of the cans when the cans are being transported between the first and second transport arrangements;

wherein the coupling arrangement further has a first clutch for connecting the first gear train to the first gear, and a second clutch for connecting the second gear train to the second gear.

13. The assembly according to claim 12, further comprising:

an actuator driving in common the first gear train, the second gear train, and the coupling arrangement.

14. The assembly according to claim 12, wherein each of the first and second transport arrangements include a plurality of vacuum fixtures adapted for engaging the cans when the cans are being transported relative to the first and second bases, respectively.

15. The assembly according to claim 12, further comprising:

a vacuum source selectively connectable to sets of the vacuum fixtures of the first transport arrangement, the second transport arrangement, and the transfer wheel.

16. The assembly according to claim 12, wherein the first clutch includes a first sleeve that is axially displaceable with respect to the first gear, and the second clutch includes a second sleeve that is axially displaceable with respect to the second gear.

17. The assembly according to claim 12, wherein the linking apparatus further includes a frame fixedly connected to at least one of the first and second machines, the frame relatively rotatably supporting the intermediate gear and the transfer wheel.

18. The assembly according to claim 17, wherein the frame includes a housing surrounding the first gear, the second gear, and the intermediate gear.

19. The assembly according to claim 12, wherein the coupling arrangement is offset axially with respect to the first and second gear trains.

20. A method of transferring cans between a first machine and a second machine, the first machine including a first gear train and the second machine including a second gear train, the method comprising:

connecting a coupling arrangement adapted for synchronizing rotation of the first and second gear trains, such that the second gear train is independently rotatable with respect to the first gear train, the coupling arrangement including:

a first gear adapted to be connected for common rotation with the first gear train, a second gear adapted to be connected for common rotation with the second gear train, the second gear being coupled for interrelated rotation with the first gear, and an intermediate gear coupled for interrelated rotation between the first and second gears; and connecting a transfer member for common rotation with the intermediate gear, the transfer member being adapted for receiving the cans from one of the first and second machines and discharging the cans to another of the first and second machines.

21. The method according to claim 22, wherein the first gear is adapted to be axially offset with respect to the first gear train, and the second gear is adapted to be axially offset with respect to the second gear train.

22. The method according to claim 21, wherein a first clutch is adapted to connect the first gear for common rotation with the first gear train, and a second clutch is adapted to connect the second gear for common rotation with the second gear train.

23. The method according to claim 22, further comprising:

displacing axially a sleeve of at least one of the first and second clutches with respect to the corresponding first and second gear.

24. The method according to claim 22, further comprising:

displacing axially respective sleeves of the first and second clutches with respect to the corresponding first and second gears.

25. The method according to claim 20, further comprising:

supporting the first, second, and intermediate gears for respective rotation with respect to a frame; and surrounding the first, second, and intermediate gears with a housing cooperating with the frame.

26. The method of claim 20, further comprising:

the transfer member receiving the cans from one of the first and second machines;

the transfer member discharging the cans to another of the first and second machines; and wherein the transfer member comprises a star wheel.

27. An assembly for shaping cans, the assembly comprising:

a first machine adapted for performing a can shaping operation, the first machine including a first base, a first transport arrangement adapted for moving the cans relative to the first base, and a first gear train driving the first transport arrangement;

a second machine adapted for performing a can shaping operation, the second machine including a second base, a second transport arrangement adapted for moving the cans relative to the second base, and a second gear train driving the second transport arrangement; and a linking apparatus synchronously connecting the first and second gear trains and adapted for transporting the cans between the first and second transport arrangements, the linking apparatus including:

a coupling arrangement having a first gear rotating in common with the first gear train, a second gear rotating in common with the second gear train, and an intermediate gear rotatably interengaging the first and second gears, wherein the coupling arrangement is axially offset with respect to the first and second gear trains; and a transfer wheel rotating in common with the intermediate gear and having a plurality of vacuum fixtures adapted for respectively engaging ones of the cans when the cans are being transported between the first and second transport arrangements.

* * * * *